US006315499B1

(12) United States Patent
Kittson

(10) Patent No.: US 6,315,499 B1
(45) Date of Patent: Nov. 13, 2001

(54) GEOTEXTILE FABRIC

(75) Inventor: Mark Kittson, Niagara Falls (CA)

(73) Assignees: Saint Cobain Technical Fabrics Canada, Ltd., St. Catharines (CA); CertainTeed Corp., Valley Forge, PA (US)

( * ) Notice: Subject to any disclaimer, the term of this patent is extended or adjusted under 35 U.S.C. 154(b) by 0 days.

(21) Appl. No.: 09/283,943

(22) Filed: Apr. 1, 1999

(51) Int. Cl.[7] ..... E02D 3/00
(52) U.S. Cl. ..... 405/258.1; 405/16
(58) Field of Search ..... 405/258, 21, 16; 428/378

(56) References Cited

U.S. PATENT DOCUMENTS

| | | | | |
|---|---|---|---|---|
| 3,857,934 | * | 12/1974 | Bernstein et al. | 424/30 |
| 4,117,686 | | 10/1978 | Hilfiker . | |
| 4,263,362 | * | 4/1981 | Straka | 428/258 |
| 4,273,476 | | 6/1981 | Kotulla et al. . | |
| 4,284,444 | * | 8/1981 | Bernstein et al. | 156/60 |
| 4,472,086 | * | 9/1984 | Leach | 405/258 |
| 4,540,311 | | 9/1985 | Leach . | |
| 4,610,568 | * | 9/1986 | Koerner | 405/258 X |
| 4,616,959 | | 10/1986 | Hilfiker . | |
| 4,643,119 | | 2/1987 | Langston et al. . | |
| 4,663,231 | * | 5/1987 | Girgis et al. | 428/378 |
| 4,699,542 | | 10/1987 | Shoesmith . | |
| 4,762,750 | * | 8/1988 | Girgis et al. | 428/378 |
| 4,762,751 | * | 8/1988 | Girgis et al. | 428/378 |
| 4,837,387 | * | 6/1989 | Van de Pol | 405/258 X |
| 4,856,939 | | 8/1989 | Hilfiker . | |
| 4,957,390 | | 9/1990 | Shoesmith et al. . | |
| 4,960,349 | * | 10/1990 | Willibey et al. | 405/258 X |
| 4,992,003 | | 2/1991 | Perach . | |
| 5,057,172 | * | 10/1991 | Woiceshyn | 428/247 X |
| 5,091,247 | | 2/1992 | Willibey et al. . | |
| 5,108,224 | | 4/1992 | Cabaniss et al. . | |
| 5,110,627 | | 5/1992 | Shoesmith et al. . | |
| 5,152,633 | | 10/1992 | Mercer et al. . | |
| 5,161,917 | | 11/1992 | Papetti . | |
| 5,163,261 | | 11/1992 | O'Neill . | |
| 5,246,306 | | 9/1993 | Shoesmith et al. . | |
| 5,246,765 | * | 9/1993 | Lussi et al. | 428/203 |
| 5,267,816 | | 12/1993 | Mercer et al. . | |
| 5,273,804 | | 12/1993 | Brian et al. . | |
| 5,393,559 | | 2/1995 | Shoesmith et al. . | |
| 5,419,092 | | 5/1995 | Jaecklin . | |
| 5,735,640 | * | 4/1998 | Meyer et al. | 405/258 |
| 6,032,454 | * | 3/2000 | Damour et al. | 57/904 |

FOREIGN PATENT DOCUMENTS 0 637 658 A1 8/1995 (EP) .

OTHER PUBLICATIONS

Miyata, K., Walls Reinforced with Fiber Reinforced Plastic Geogrids in Japan, Geosynthetics Intl., 1996, vol. 3, No. 1, p1–11.

* cited by examiner

*Primary Examiner*—David Bagnell
*Assistant Examiner*—Jong-Suk Lee
(74) *Attorney, Agent, or Firm*—Duane, Morris & Heckscher LLP

(57) ABSTRACT

A geotextile fabric constructed as a bi-axially oriented, open grid of high modulus of elasticity strands impregnated with resinous material which is flexible when cured. The fabric may be stored and installed in roll or sheet form and provides high-strength, low-strain reinforcement of earthen structures which is resistant to abrasion, water and chemical attack from soil.

3 Claims, 1 Drawing Sheet

GEOTEXTILE FABRIC

FIELD OF THE INVENTION

The present invention relates in general to soil reinforcement fabrics and in particular to geotextile fabrics for reinforcing earthen structures.

BACKGROUND OF THE INVENTION

Geotextile fabrics are commonly used to stabilize or reinforce earthen structures such as retaining walls, embankments, slopes and the like. Existing technologies include polyolefins (e.g., polypropylene and polyethylene) and polyesters which are formed into flexible, grid-like sheets. The sheets are stored on rolls and placed at the job site in one or more spaced apart generally horizontal layers depending on the height and reinforcement requirements of the earthen structure.

Despite ease of manufacture and installation, polyolefin and polyester grids are low modulus of elasticity materials typically having Young's moduli on the order of about 10,000 to about 75,000 psi for polyolefin grids and from about 75,000 to about 200,000 psi for polyester grids. Such low modulus products display high strain when subjected to the stresses in typical earthen structures. In some cases overlying soil and other forces associated with or imposed upon the earthen structure may induce as much as twelve inches of strain in polyolefin grids directions substantially transverse to the face of the earthen structure. Strains of this magnitude may destabilize not only the soil structure itself but also nearby structures such as buildings or roadways directly or indirectly supported by the soil structure.

Polyolefin grids may also undergo considerable creep when subjected to substantially constant loadings of the nature and magnitude of those typically exerted by or upon earthen structures. Thus, even if the short term strains are innocuous, the long term creep effects of polyolefin grids may be sufficient to threaten the integrity of the reinforced earthen structure and its surroundings.

Geotextile fabrics incorporating high modulus of elasticity materials have also been proposed for reinforcement of roadway structures. Examples include roadway reinforcement fabrics as described in U.S. Pat. Nos. 4,699,542, 4,957,930, 5,110,627, 5,246,306 and 5,393,559. These fabrics typically comprise elongate grid-like sheets wherein substantially parallel strands of high modulus material such as glass fiber rovings or the like extend in the longitudinal (or "warp" or "machine") direction of the fabric and in the transverse (or "weft" or "cross-machine") direction thereof. The glass strands are connected to one another so as to form an open grid and the entire assembly may be coated with a resinous material. Glass fiber roving strands have far higher moduli of elasticity and creep resistance than comparably sized polyolefin or polyester strands. For instance, the modulus of elasticity of a typical glass fiber strand in a geotextile fabric may be on the order of about 1,000,000 to about 4,000,000 psi. Glass strands can thus withstand much greater stress and undergo much less strain than comparably sized polyolefin or polyester strands. As such, glass-based geotextile fabrics generally provide superior reinforcement of earthen structures in relation to polyolefin or polyester grids.

The resinous coating material is applied to the glass fiber strands at a level of 10% to 15% DPU (dry-weight pick up), i.e., 10 to 15 parts dry weight of resin to 100 parts by weight of glass fiber. The resin coating is sufficient to protect the glass fiber strands from the comparatively benign installation and environmental conditions associated with roadway reinforcement applications. Additionally, the coating provides slight to moderate stiffness to the fabric such that it may be stored in rolls and easily handled at the job site.

In research and development culminating in the present invention, it has been observed that the commercial embodiments of the roadway reinforcement fabrics disclosed in the aforementioned U.S. patents, which are manufactured by Bayex Limited of Ontario, Canada, under the trademark GlasGrid® are unsuitable for soil reinforcement applications. More specifically, the resin which impregnates the fabric is incapable of withstanding the more rigorous physical and chemical demands associated with typical soil reinforcement applications. Most soil includes uncoated particles and stones which can be highly abrasive. In contrast, the aggregate used in asphaltic concrete is coated with asphalt which essentially eliminates the abrasiveness of the aggregate. Indeed, the art of reinforcing asphaltic concrete roadways remains somewhat underdeveloped and inexact. This may be due at least in part to the fact that roadway reinforcement materials do not experience the considerable exposure to potentially damaging factors that are routinely encountered by soil reinforcement materials during their installation and use.

In contrast to road reinforcements, use of reinforcements for soil stabilization is an established science. Longstanding and extensive reference texts and test procedures (e.g., ASTM, Drexel Test Procedures, FHWY Tests, etc.) have been developed that establish soil stabilization and the usage of reinforcements therein standard science. Upon examination of this field of technology and fabric reinforcement used therein, it was determined that rugged and rollable fiberglass fabric had not been successfully used in soil stabilization even though the science of soil reinforcement was well established.

Upon examination of existing soil reinforcements such as polyolefin and polyester grids, it was determined that design and usage of existing reinforcements required the grid structures to come under high strains to effectuate their soil reinforcement characteristics. Standard designs of wall structures or embankments using such grids require allowance for 5% to 10% strain levels on the grid structures in order to stress them sufficiently to capitalize upon their tensile reinforcement capabilities. With the use of fiberglass, however, which typically exhibits an ultimate strain of less than about 2%, it became apparent to the present inventor that such a reinforcement material may have applications in earthen structure designs that could tolerate only small strains. With this objective in mind, further investigations into a possible fiberglass soil reinforcement were conducted.

Standard engineering practice requires the consideration of a number of factors when selecting reinforcements for use in soil applications. Such factors typically include: (1) chemical resistance, i.e., the resistance of the reinforcement material to tensile degradation in various chemical environments, (2) UV resistance, i.e., the deterioration of a material's reinforcement properties responsive to ultraviolet (UV) radiation exposure, (3) construction damage resistance, i.e., the tensile strength retention capability of reinforcements under construction conditions using different soils (e.g., stone size distributions from fine silt to 3" coarse stone), (4) creep resistance, i.e., the property of a material to stretch and lose tensile strength with time while under stress. And, because coated fiberglass fabric materials were being considered by the present inventor, it was also necessary to consider the friction characteristics between reinforcements and surrounding soils which characteristics are dependant on the fabric's mesh opening size and coating chemistry. Although it had not been successfully produced, the present inventor believed that a reinforcement could be designed with fiberglass as the base reinforcement coated with a thermoplastic coating sufficient to satisfy these essential soil reinforcement design considerations.

Initial investigations for useful fiberglass soil reinforcement were focussed upon commercially available GlasGrid® asphaltic roadway reinforcement, a flexible coated fiberglass reinforcement available in roll form. It was quickly determined that the 10 to 15 DPU coating was insufficient to protect the fiberglass, which is a brittle material, from the harsh construction conditions associated with the erection of earthen structures. Testing indicated up to 70% tensile strength loss under construction situations was possible, thereby rendering GlasGrid® impractical as a soil reinforcement material. It is believed that the bitumen coated aggregates (standard particle size ranging from 1/16 to 1") used in asphalt represented a much less abrasive environment than that observed in soil applications which enabled GlasGrid® to be of beneficial use in asphaltic roadway installations but not soil structures. In light of this testing, the present inventor believed that a substantially different coating would have to be employed in order to render a GlasGrid®-type product useful as a reinforcement for earthen structures.

The standard GlasGrid® product that was tested had a grid opening size of 12 mm to 8 mm to allow for asphalt overlay adhesion to existing roads. This grid opening size was acceptable for the comparatively small aggregates used in asphalt roadway designs. In contrast, however, standard designs for soil reinforcement mesh openings are characteristically about 1" to as large as 12" to allow for proper aggregate interlock through the reinforcement. In addition to its unsuitable coating, the grid opening size of the standard GlasGrid® materials also contributed to the failure of GlasGrid® as a viable soil reinforcement product.

A fiberglass-based soil reinforcement fabric is described in "Walls Reinforced with Fiber Reinforced Geogrids in Japan" authored by K. Miyata and published in Vol., 3, No. 1, *Geosynthetics International* (1996). The design referred to therein is a fiberglass reinforcement with a rigid coating based on a vinyl ester resin (thermosetting rather than thermoplastic chemistry).

Fiberglass embedded in thermosetting resin has favorable creep characteristics, as well as good chemical resistance and abrasion resistance. However, the difficulty with this technology when deployed in soil reinforcement applications is that the thermosettings coatings render the material so stiff that it cannot be formed into rolls for rapid and convenient field application. Such products must be manufactured and sold as board-like sheets which would make them impractical for large scale soil reinforcement applications. From inception, the present inventor sought coated fiberglass reinforcement available in roll form to allow for easy unrolling in the field. Fiberglass reinforcement fabric embedded in thermosettable resins does not satisfy this criterion.

Use of vinyl ester resins also necessitates that measures be taken to assure their safe handling and disposal. Vinyl ester resins require dispersing solvents such as styrene for proper handling and processing. Solvents such as styrene are toxic, pollutant and have a low flash point (e.g., 88° F. for styrene monomer). And, styrene and many other solvents suitable for dispersing vinyl ester resins have either been identified as or are suspected of being carcinogens. As such, precautions such as mandatory protective worker clothing and equipment, as well as extensive material handling training, must be implemented to prevent harm to the worker and the environment. Such measures add to the cost of manufacturing which, in turn, increases the cost of the vinyl ester resin impregnated geotextile end product.

An advantage exists, therefore, for a high modulus, open mesh, resin impregnated, geotextile fabric which is comparatively safe and inexpensive to manufacture, easy to handle and store in roll, sheet or other form, and is resistant to chemical degradation when used to reinforce earthen structures.

SUMMARY OF THE INVENTION

The present invention provides a geotextile fabric for use in reinforcement of earthen retaining walls, embankments, slopes and related structures. The fabric comprises high modulus of elasticity strands extending in the warp and weft directions of the fabric. The high modulus strands preferably comprise bundled glass fibers which are connected to one another with heavy polyester yarn so as to establish an open grid fabric. The fabric is coated with resinous material. The resinous coating slightly stiffens the fabric to thereby facilitate its handling but not rendering the fabric so rigid as to prevent rolling of the fabric onto cores and unrolling of the fabric at the job site. The resinous material impregnates and coats the fabric to an extent sufficient to protect the glass strands from external damage from abrasive soil particles and from internal friction damage as the fabric is rolled on and off storage cores. Moreover, the resinous coating is of a composition suitable to resist moisture and chemical degradation when the fabric is installed in an earthen structure.

The fabric may be cut and stored in sheets or rolls. When laying the fabric in roll form, a roll of the fabric is placed at one end of the face of the earthen structure being constructed and simply unrolled in a direction generally parallel to the structure's face. Hence, there is no need to cut and maneuver individual sections or sheets of the fabric and installation time and effort are minimized. Additionally, the fabric rolls may be easily manufactured or precut to any desired width to satisfy virtually any installation requirements.

Other details, objects and advantages of the present invention will become apparent as the following description of the presently preferred embodiments and presently preferred methods of practicing the invention proceeds.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
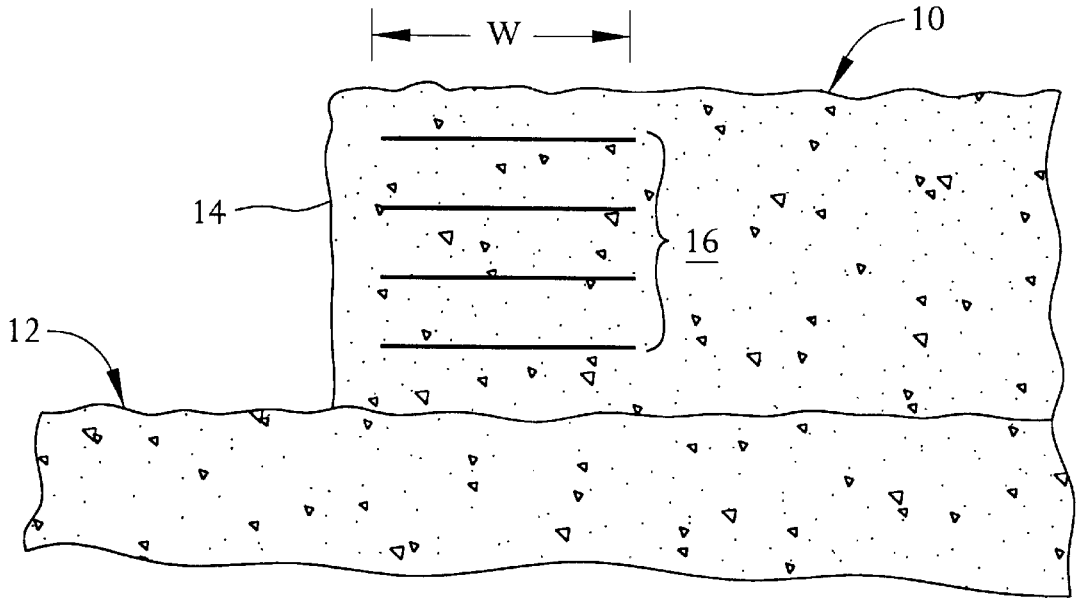
FIG. 1 is an elevational cross-section view of an earthen structure reinforced with geotextile fabric.

Referring to FIG. 1, there is shown an earthen structure 10 resting atop a suitable natural or artificial foundation 12. The face 14 of structure 10 may form an angle of between about 10° to, as illustrated, about 90° with respect to foundation 10. Structure 10 may be any height and may include one or more strata of substantially horizontally disposed reinforcement 16. Reinforcement 16 normally has a width W of several feet and spans substantially the entire length of the face 14 of structure 10. A typical ten foot high earthen retaining wall structure, for example, may include about two to about four strata of five to six feet wide reinforcement 16 spaced inwardly from the structure face 14 by a few inches to a few feet.

When impregnated with the resinous material described later herein, the fabric grid of the present invention can be rolled-up on a core and transported to the place of installation as a roll, where it may readily be rolled out continuously for rapid, economical, and simple incorporation into an earthen structure. For example, it can be placed on rolls of from about one to about 20 feet wide containing a single piece up to 100 yards or more in length.

The impregnated fabric grid, though semi-rigid, tends to lie flat when unrolled. This is believed to be due to the proper selection of resin composition and the use of appropriate strands in the grid. The large grid openings permit substantial contact between underlying and overlying layers of soil. This permits substantial transfer of stresses from the soil to the strands of the fabric.

The grid may be formed of warp and weft strands of continuous bundled filament glass fibers, though other high modulus fibers such as, for example, carbon fibers, graphite fibers, or polyamide fibers of poly(p-phenylene terephthalamide) known as Kevlar® may be used. ECR or E glass rovings of 2000 tex are preferred, though one could use weights ranging from about 134 to about 5000 tex. These strands, which are preferably low twist (i.e., about one turn per inch or less), are disposed substantially parallel to one another at a spacing of about ¾" to 1", though spacing ranging from ⅛" to 6" inches may be used. The strands are preferably stitched or otherwise loosely connected to one another via chain loops, tricot loops or the like, with tough yet supple thread or yarn such as 70 to 2000 denier polyester yarn or the like. The openings established by the warp and weft strands preferably range from about ¾" to 1" on a side, though openings ranging from about ⅛" to 6" inches on a side may be used. The strands may be united using warp-knit, weft-insertion knitting apparatus or other conventional weaving equipment.

Once the grid is formed, and before it is laid in place in an earthen structure, a resin is applied. That is to say, the grid is "pre-impregnated" with resin. The resin is preferably applied at a level of about 100% to about 300% DPU (dry-weight pick up), i.e., about 100 to about 300 parts dry weight of resin to 100 parts by weight of glass fiber. To ensure flexibility and, therefore, rollability of the grid upon impregnation by the resin, the resin must be selected such that it remains flexible when cured.

The viscosity of the resin is selected so that it penetrates into the strands of the grid. While the resin may not surround every filament in a glass fiber strand, the resin is generally uniformly spread across the interior of the strand. This impregnation makes the grid semi-rigid and cushions and protects the glass strands and filaments from corrosion by water and other elements in the soil environment. The impregnation also reduces abrasion between glass strands or filaments and the cutting of one glass strand or filament by another which is particularly important after the grid has been laid down but before the overlayment has been applied.

The grid should preferably have a minimum strength of 10 kiloNewtons per meter (kN/m) in both the warp and weft directions, more preferably at least 50 kN/m and up to about 100 kN/m or more.

Investigations were initiated to evaluate different technologies that would allow high levels of coatings to be dispensed onto the fiberglass fabric grid. Successful technologies included hot melt coatings (100% solids using heat as the dispensing medium) such as ethylene-vinyl acetate copolymers (EVAs) and plastisols (high solids coating requiring thermo-fusing to solidify the coating). Prototypes were developed with both systems. A number of experiments were conducted to determine the effects of high coating levels on the reinforcement.

The objective of the first experiment was to determine whether the coating would eventually deteriorate in terms of adhesion to the glass under a constant stress, a creep type situation. Tests were conducted to determine the creep characteristics of the design for 10,000 hours. The results were encouraging showing a factor of safety of 1.66 (successful support of a static load equivalent to 66% of the ultimate tensile of the reinforcement), similar to existing polyester-based grid soil reinforcement materials sold in this market.

Next, construction damage due to application conditions and soils being used was evaluated. The objective of this experiment was to determine whether the coatings were sufficiently protecting the reinforcement. Tests were conducted where a mock soil installation was erected with a coated fiberglass fabric followed by excavation and retesting. Factors of safety ranged between 1.05 and 1.66 (95% and 66% tensile retention, respectively) depending on the aggregate size, which again correlated well with existing reinforcements.

Concerns over the interaction of the coating with the fiberglass and with the surrounding soil were next investigated. It was thought that the high level of coating (100 to 300 DPU) being used may unintentionally introduce a flexible interface between the reinforcement and soil thereby nullifying the reinforcing effects under low strains. Pull out testing was conducted to examine this phenomenon. It was determined that the coating did not inhibit the low strain reinforcing characteristics of the reinforcement. Moreover, high friction angles (interaction of reinforcement and surroundings) were observed as well as high stresses being required to generate low strains. These results, together with the other favorable test results enumerated above, confirmed the efficacy of the instant coated fiberglass grid reinforcement design for use as a soil reinforcement.

In light of this research, it would appear that the level of coating is a significant consideration for designing an effective fiberglass soil reinforcement since the coating becomes critical in protecting the reinforcement against damage due to installation or handling. The coating chemistry must be such that it is compatible with fiberglass. The coating must also provide good chemical and water resistance as well as render the soil reinforcement end product sufficiently flexible to be manufactured and stored in roll form. Additionally, the fiberglass grid openings must be sufficiently large to accommodate the aggregates encountered in earthen structures to afford a high degree of mechanical interlock among aggregates and the reinforcement.

Preferred resinous coatings which have been found to satisfy all of the objectives of the present invention are polyvinyl chloride (PVC) organosol or, more preferably, PVC plastisol resins. PVC organosols have somewhat lower solvent levels than plastisols which offers safety and plant emissions advantages. However, organosols generally have higher viscosities which may render them more difficult to handle and less able to thoroughly impregnate the strands of the fabric than plastisols.

A suitable PVC organosol or plastisol composition suitable for use in the present invention may be formulated as follows (wherein the quantities are expressed in unit volumes or parts):

TABLE 1

| Constituent | Quantity |
|---|---|
| PVC resin | 50–150 parts |
| Plasticizer | 10–300 parts |
| Stabilizers | 2–10 parts |
| Fillers | As needed* |
| Surfactants | As needed* |
| Pigments | As needed* |
| Diluents | As needed* |

*Constituents included on an "as needed" basis are provided dependent on process, cost and specific application requirements.

Preferred PVC resins according to the present invention include multipurpose dispersion resins, copolymer dispersion, specialty dispersion, low-soap and high-soap dispersion resins.

Suitable plasticizers include monomeric (e.g. phthalates) or polymeric (polyester based) plasticizers. The grade of plasticizer is selected to balance the PVC and fabric processing requirements with the physical or performance criteria of the end-product fabric. These include fusion temperature, viscosity, flame retardency, light and heat stability, end-product flexibility, migration, minimum PVC tensile strength, glass protection, low temperature flexibility, general handling under ambient conditions, etc. A presently preferred formulation employs monomeric plasticizers.

Stabilizers are used to heat stabilize the inherently thermally unstable PVC resin. Stabilizers may be composed of metals and blends thereof as well as organic materials. Numerous types are suitable for the present formulation including barium/zinc, calcium/zinc, magnesium/aluminum/zinc, potassium/zinc, barium/cadmium, tin, epoxidized soybean oil, etc. According to a presently preferred formulation, barium/zinc is used in combination with epoxidized soybean oil as such combination of stabilizers provides a favorable balance of heat stabilization and discoloration resistance of the geotextile fabric.

Common fillers include calcium carbonates, calcium sulfates, barium sulfates, clay, antimony oxide, aluminum trihydrate and fumed silicas and are used primarily to reduce cost. Primary property considerations in the selection of suitable fillers include particle size distribution and oil absorption as these affect the viscosity and rheology of the PVC compound.

Surfactants are generally not required but can be used to assist in dispersion, viscosity control and air release.

Pigments are used for primarily as coloring agents but can also be used as secondary or primary ultraviolet (UV) stabilizers as well as processing aids.

Diluents or solvents are provided to control viscosity of the resinous coating material. Suitable solvents include, without limitation, dodecylbenzene, TXIB (texanol isobutyrate) and mineral spirits. Mineral spirits are preferred, however, because they are an effective diluent with minimal volatile organic compound (VOC) concerns. That is, mineral spirits have a comparatively high flash point and comparatively low odor versus other solvents.

A preferred warp knit, weft inserted fabric 24 may be prepared using 2000 tex rovings of continuous filament fiberglass in cross-machine (weft) direction. These rovings may be joined together by any conventional stitching, weaving, knitting or related process using 1000 denier continuous filament polyester thread into a structure having openings of from about ⅛" to about 6" on a side. The structure is thereafter saturated at least about 120% DPU with a PVC plastisol. This thorough impregnation with resin serves to protect the glass filaments from the corrosive effects of water and soil chemical attack, reduce friction between the filaments, and resist soil particle abrasion which can tend to damage the filaments and reduce the strength of the fabric. The resulting grid may weigh from about 25 to about 10,000 grams per square meter and may have a tensile strength across the width of about 10 to about 400 kN/m. The modulus of elasticity may be about 500,000 to about 4,000,000 psi and the grid can be rolled and handled with relative ease.

The geotextile fabric according to the present invention may be installed on an earthen structure sequentially, in the form of sheets laid edge to edge, or substantially continuously, in the form of an unrolled strip or web. If stored on a roll, a roll of fabric may be disposed adjacent one end of and earthen structure near the face thereof. Then, the roll of fabric may be unrolled in a direction generally parallel to the structure's face until it substantially spans the length of the structure. There is no need to cut and place individual sections of the fabric. As such, the time and effort required to install the fabric, especially in large-scale installations, are considerably less than when the fabric is incrementally installed as adjacent sheets.

Although the invention has been described in detail for the purpose of illustration, it is to be understood that such detail is solely for that purpose and that variations can be made therein by those skilled in the art without departing from the spirit and scope of the appended claims and the equivalents therefore.

What is claimed is:

1. An open grid rollable soil reinforcement fabric comprising an open grid of high modulus of elasticity glass fiber strands, said open grid being at least partially impregnated with a polyvinyl chloride, PVC, resinous organosol or plastisol material which is flexible when cured, said resinous organosol or plastisol material comprising about 50 to about 150 parts PVC resin, about 10 to about 300 parts plasticizer, and about 2 to about 10 parts stabilizer.

2. The fabric of claim 1 wherein said resinous material is applied at a level of about 100% to about 300% dry-weight pick up.

3. The fabric of claim 1 wherein said strands define openings of about ⅛" to about 6" on a side.

* * * * *

UNITED STATES PATENT AND TRADEMARK OFFICE

CERTIFICATE OF CORRECTION

PATENT NO. : 6,315,499 B1 
DATED : November 13, 2001
INVENTOR(S) : Mark Kittson

It is certified that error appears in the above-identified patent and that said Letters Patent is hereby corrected as shown below:

Title page,
Item [73], Assignees, delete "Saint Cobain" and insert therefor -- Saint-Gobain --.

Signed and Sealed this

Twentieth Day of August, 2002

*Attest:*

*Attesting Officer*

JAMES E. ROGAN
*Director of the United States Patent and Trademark Office*